US010389067B2

(12) United States Patent
Xu

(10) Patent No.: US 10,389,067 B2
(45) Date of Patent: Aug. 20, 2019

(54) SHIELDING PLATE WITH DUAL CONTACTING BEAMS IN ONE HOLE

(71) Applicant: FOXCONN INTERCONNECT TECHNOLOGY LIMITED, Grand Cayman (KY)

(72) Inventor: Yin-Chao Xu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/839,887

(22) Filed: Dec. 13, 2017

(65) Prior Publication Data

US 2018/0166832 A1 Jun. 14, 2018

(30) Foreign Application Priority Data

Dec. 13, 2016 (CN) ..... 2016 2 1362900 U

(51) Int. Cl.

| | |
|---|---|
| ***H01R 24/60*** | (2011.01) |
| ***H01R 13/6582*** | (2011.01) |
| ***H01R 13/6596*** | (2011.01) |
| ***H01R 13/6588*** | (2011.01) |
| *H01R 107/00* | (2006.01) |
| *H01R 13/6594* | (2011.01) |
| *H01R 13/6466* | (2011.01) |
| *H01R 13/6587* | (2011.01) |
| *H01R 24/64* | (2011.01) |

(52) U.S. Cl.

CPC ..... *H01R 13/6582* (2013.01); *H01R 13/6588* (2013.01); *H01R 13/6596* (2013.01); *H01R 24/60* (2013.01); *H01R 13/6466* (2013.01); *H01R 13/6587* (2013.01); *H01R 13/6594* (2013.01); *H01R 24/64* (2013.01); *H01R 2107/00* (2013.01)

(58) Field of Classification Search

CPC .... H01R 23/02; H01R 24/60; H01R 13/6466; H01R 24/64; H01R 13/6587; H01R 13/6594; H01R 23/6873; H01R 23/7073

USPC ..... 439/660, 676, 607.4

See application file for complete search history.

(56) References Cited

U.S. PATENT DOCUMENTS

| | | | | |
|---|---|---|---|---|
| 8,808,029 | B2 | 8/2014 | Castillo et al. | |
| 9,461,378 | B1 * | 10/2016 | Chen | H01R 12/707 |
| 2016/0064866 | A1 * | 3/2016 | Kao | H01R 13/6471 439/676 |

(Continued)

FOREIGN PATENT DOCUMENTS

| | | |
|---|---|---|
| CN | 205141284 U | 4/2016 |

*Primary Examiner* — Abdullah A Riyami
*Assistant Examiner* — Justin M Kratt
(74) *Attorney, Agent, or Firm* — Wei Te Chung; Ming Chieh Chang

(57) ABSTRACT

An electrical connector includes an insulative housing and a plurality of contacts disposed in the housing. The contacts are arranged with upper contacts in the upper row and lower contacts in the lower row. The upper contacts include the grounding contacts and the signal contacts as well as the lower contacts. A metallic shielding plate is located between the upper contacts and the lower contacts. The metallic shielding plate forms a plurality of holes. In each hole, there are upper spring beam and lower spring beam respectively contacting the front contacting sections of the grounding contacts in the upper row and in the lower row.

19 Claims, 7 Drawing Sheets

(56) References Cited

U.S. PATENT DOCUMENTS

2016/0352050 A1* 12/2016 Hu ..... H01R 13/6597
2018/0166830 A1* 6/2018 Feng ..... H01R 12/71

* cited by examiner

SHIELDING PLATE WITH DUAL CONTACTING BEAMS IN ONE HOLE

FIELD OF THE DISCLOSURE

The invention is related to an electrical connector, and particularly to the electrical connector with the shielding plate performing superior shielding effect.

DESCRIPTION OF RELATED ARTS

U.S. Pat. No. 9,257,801 discloses an electrical connector having the metallic shielding plate between two contact modules. Anyhow, such a shielding plate is not mechanically and electrically connected to the corresponding grounding contacts, thus having an inferior shielding effect.

It is desired to provide an electrical connector with the shielding plate having adjacent paired spring contacting beams in a side-by-side manner along the transverse direction to respectively touch the corresponding paired grounding contacts of the upper row and the lower row which are aligned with each other in the vertical direction.

SUMMARY OF THE DISCLOSURE

To achieve the above result, an electrical connector including an insulative housing and a plurality of contacts disposed in the housing. The housing includes a base and a tongue portion extending forwardly from the base. The tongue portion includes two opposite mating surfaces. The contact includes a front contacting section and a rear connecting section extending rearwardly from the front contacting section. The contacts are arranged with upper contacts in the upper row and lower contacts in the lower row. The upper contacts include the grounding contacts and the signal contacts as well as the lower contacts. A metallic shielding plate is located between the upper contacts and the lower contacts. The metallic shielding plate forms a plurality of holes. In each hole, there is an upper spring beam and a lower spring beam respectively contacting the front contacting sections of the grounding contacts in the upper row and in the lower row.

DETAILED DESCRIPTION OF THE PREFERRED EMBODIMENT

Figure 1:
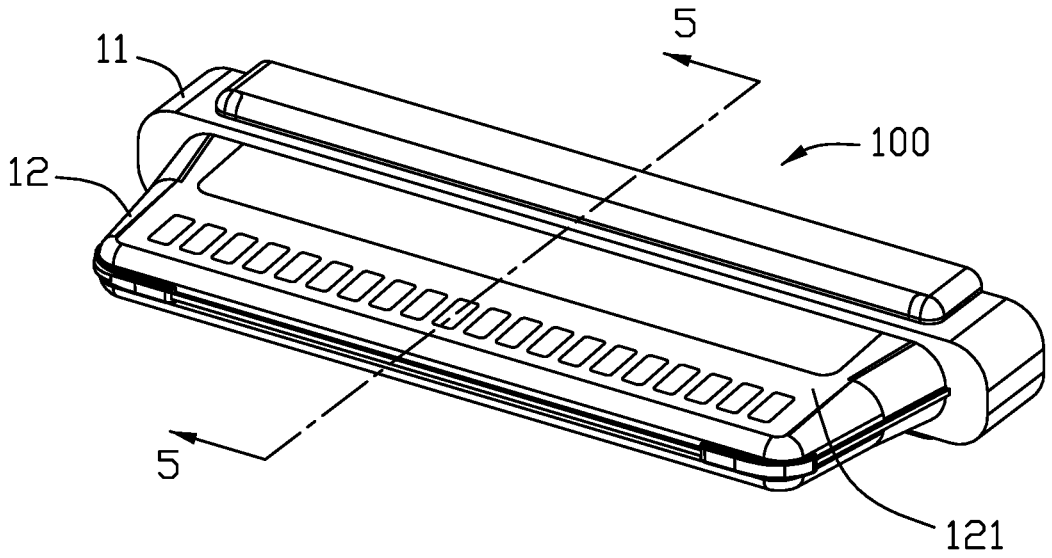
FIG. 1 is a front perspective view of an electrical connector according to the invention.
Figure 2:
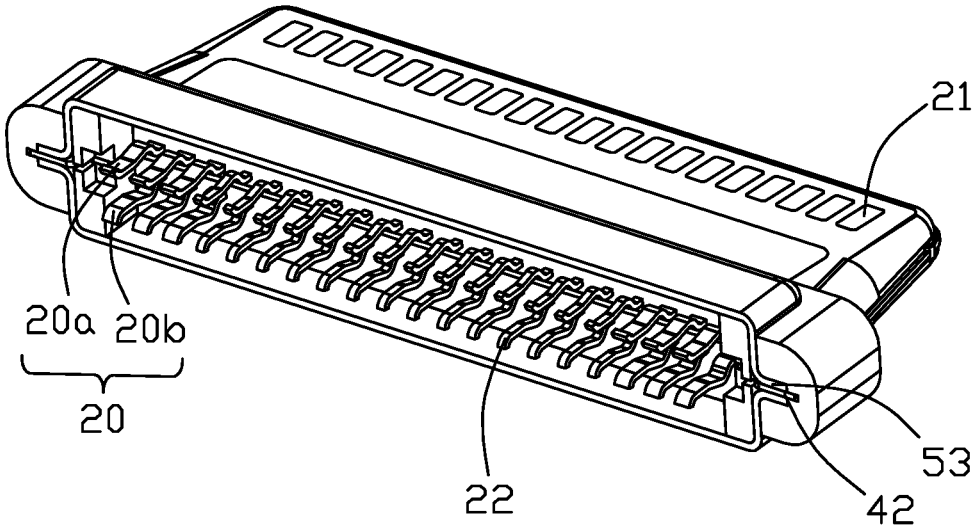
FIG. 2 is a rear perspective view of the electrical connector of FIG. 1.
Figure 3:
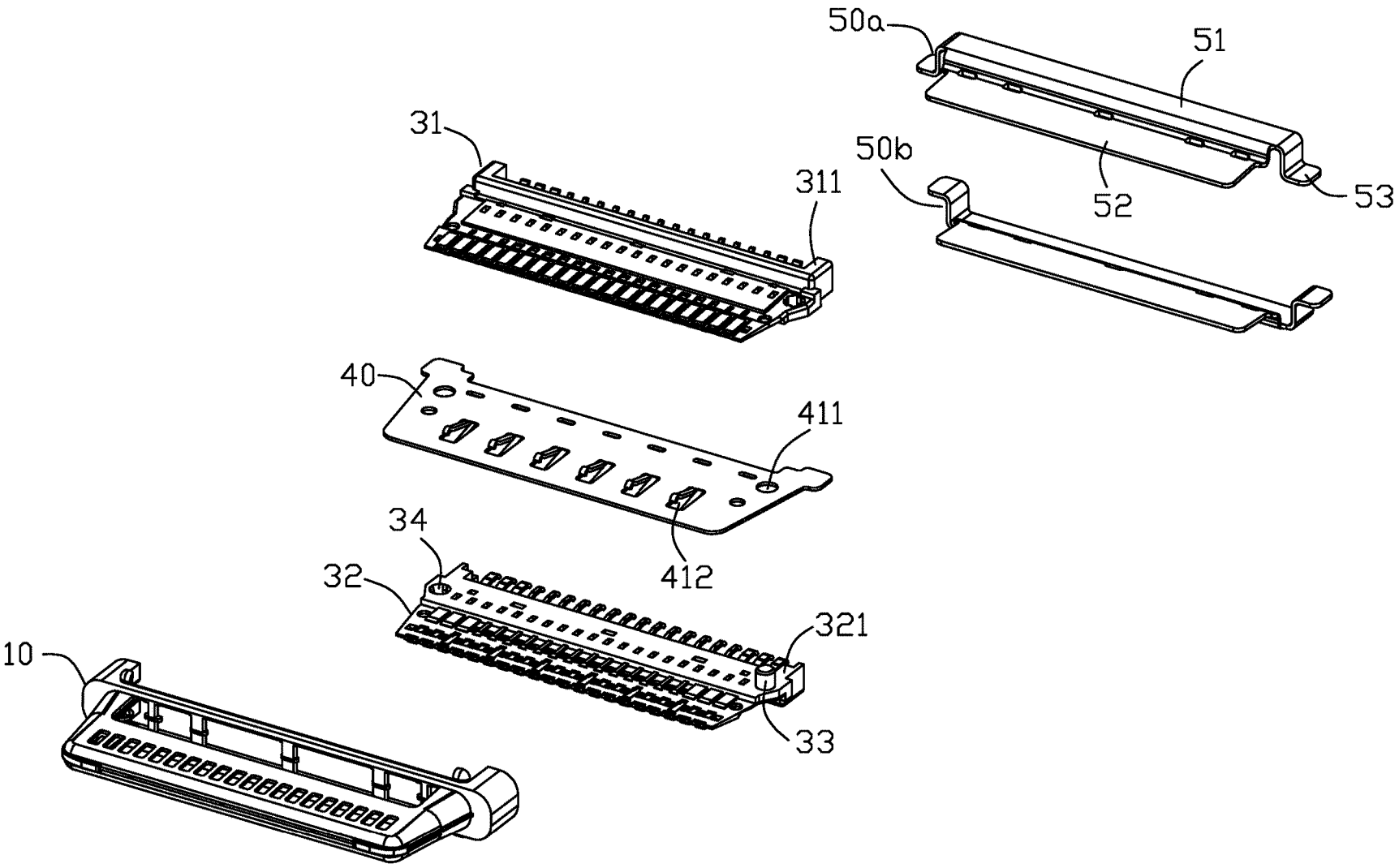
FIG. 3 is a front exploded perspective view of the electrical connector of FIG. 1.
Figure 4:
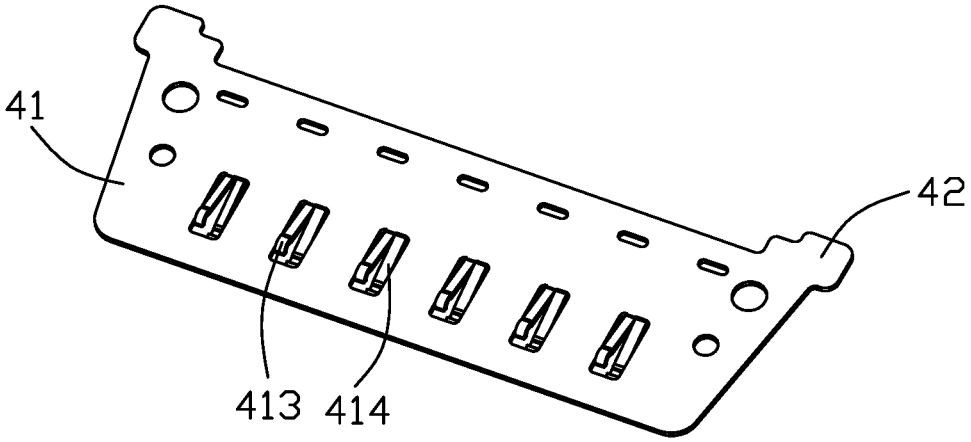
FIG. 4 is a front perspective view of the shielding plate of the electrical connector of FIG. 1.

Reference will now be made in detail to the embodiments of the present disclosure. Referring to FIGS. 1-7, which essentially show the featured structures by removing some unclaimed detailed structures for simplifying illustration thereof, an electrical connector 100 includes an insulative housing 10 and a plurality of contacts 20 retained in the housing 10. The housing 10 includes a base 11 and a mating tongue 12 extending from the base 11 forwardly in a front-to-back direction. The mating tongue 12 forms opposite mating surfaces 121. The contact 20 includes a front contacting section 21 exposed upon the mating surface 121 and a rear connecting section 22 extending rearwardly from the contacting section 21 out of the rear face 101 of the housing 10. The contacts 20 are grouped with upper contacts 20*a* in the upper row and lower contacts 20*b* in the lower row. The upper contacts 20*a* and the lower contacts 20*b* both having corresponding grounding contacts and signal/differential pair contacts alternatively arranged with each other along a transverse direction. A metallic shielding plate 40 is located between the upper contacts 20*a* and the lower contacts 20*b*.

The upper contacts 20*a* are integrally formed with the upper insulator 311 to commonly form an upper contact module 31, and the lower contacts 20*b* are integrally formed with the lower insulator 321 to commonly form a lower contact module 32. Notably, the insulative housing 1 may be applied upon the upper contact module 31 and the lower contact module 32 via an over-molding process so as to have the upper insulator 311 and the lower insulator 321 hidden, in the vertical direction, behind the housing 10 and the metallic shell 50 (illustrated later). The upper contact module 31 and the lower contact module 32 are stacked with each other via the shielding plate 40 therebetween in the vertical direction. The upper insulator 311 and the lower insulator 321 forms the positioning holes 34 and the positioning posts 33 so as to have the positioning posts 33 extend through the corresponding hole 411 of the shielding plate 40 into the corresponding positioning hole 34 for securing the upper contact module 31 and the lower contact module 32 with the shielding plate 40 therebetween.

Figure 5:
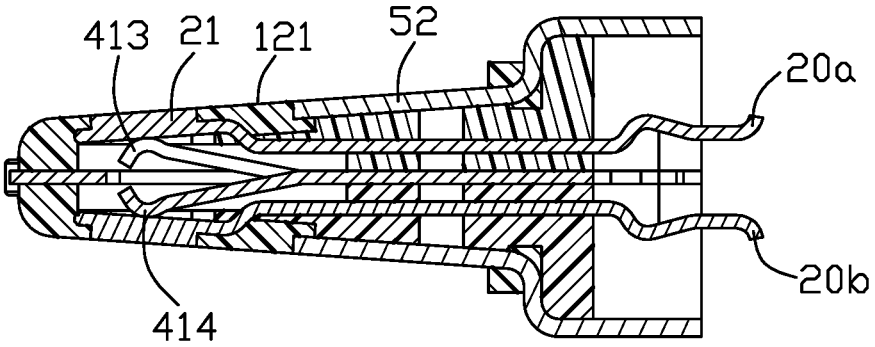
FIG. 5 is a cross-sectional view of the electrical connector of FIG. 1 along line 5-5.
Figure 7:
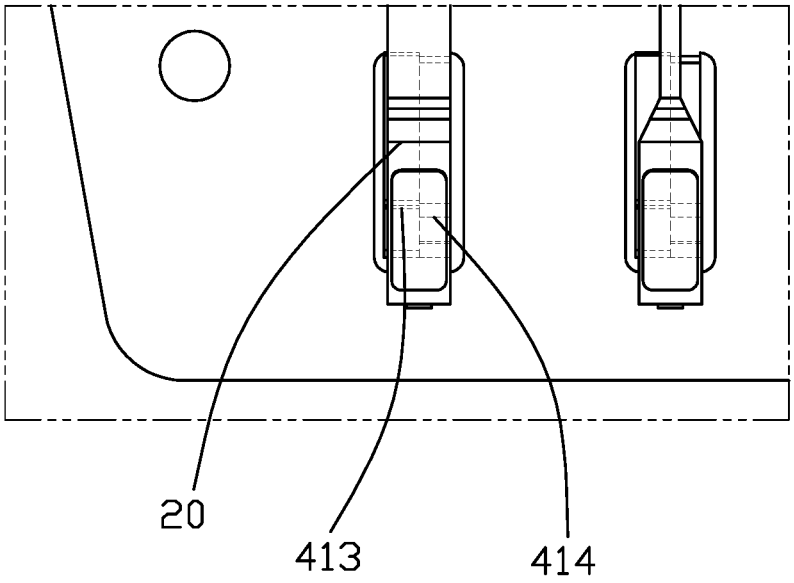
FIG. 7 is a diagram to show the relation between the spring beams of the shielding plate and the corresponding contacting section of the contact of the electrical connector of FIG. 1.

The shielding plate 40 includes a plate section 41 and a pair of ears 42. The positioning holes 411 are formed in the plate section 41. The plate section 41 further forms a plurality of holes 412 each with opposite front and rear edges in the front-to-back direction. An upward spring beam 413 and a downward spring beam 414 extend from the rear edge and are side by side adjacent to each other in the transverse direction. Referring to FIG. 5, the upward spring beam 413 upwardly contacts the contacting section 21 of the grounding contact of the upper contact 20*a*, and the downward spring beam 414 downwardly contacts the contacting section 21 of the grounding contact of the lower contact 20*b*. Notably, the upper contacts 20*a* and the lower contacts 20*b* are symmetrically arranged with each other in the vertical direction, so the upward spring beams 413 and the downward spring beam 414 are essentially located within the boundary of the contacting section 21 in the projecting or top view (FIG. 7).

The metallic shell 50 is secured upon the housing 10. The shell 50 includes an upper shell 50*a* and a lower shell 50*b* corresponding to the upper contact module 31 and the lower contact module 32. In fact, the shell 50 is integrally formed with the housing 10 when the housing 10 is over-molded upon the pre-assembled upper contact module 31, lower contact module 32 and shielding plate 40 therebetween wherein the upper shell 50*a* is also positioned upon the upper insulator 311 and the lower shell 50*b* is also positioned upon the lower insulator 321. Generally speaking, each of the upper shell 50*a* and the lower shell 50*b* includes a main part 51 covering the base 11 of the housing 10, and the extension 52 extending from the base 11, and a pair of legs 53 at two opposite ends. Notably, the extension 52 is flush with the mating surface 121 of the mating tongue 12. The ear 42 is sandwiched between the legs 53 of the upper shell 50*a* and that of the lower shell 50*b* in the vertical direction.

As mentioned before, the upper contacts 20*a* and the lower contacts 20*b* are firstly integrally formed with the upper insulator 311 and the lower insulator 321 to commonly form the upper contact module 31 and the lower contact module 32, respectively. The upper contact module 31 and the lower contact module 32 commonly sandwich the shielding plate 40 therebetween with the upper shell 50*a* and the lower shell 50*b* positioned upon the upper insulator 311 and the lower insulator 321, respectively, to form a sub-assembly. The housing 10 is finally applied upon the sub-assembly to form the complete connector 100. The shell 50 may be further assembled with the upper contact module 31 and the lower contact module 32 via glue and/or the legs 53 soldered to the ears 42.

Figure 6:
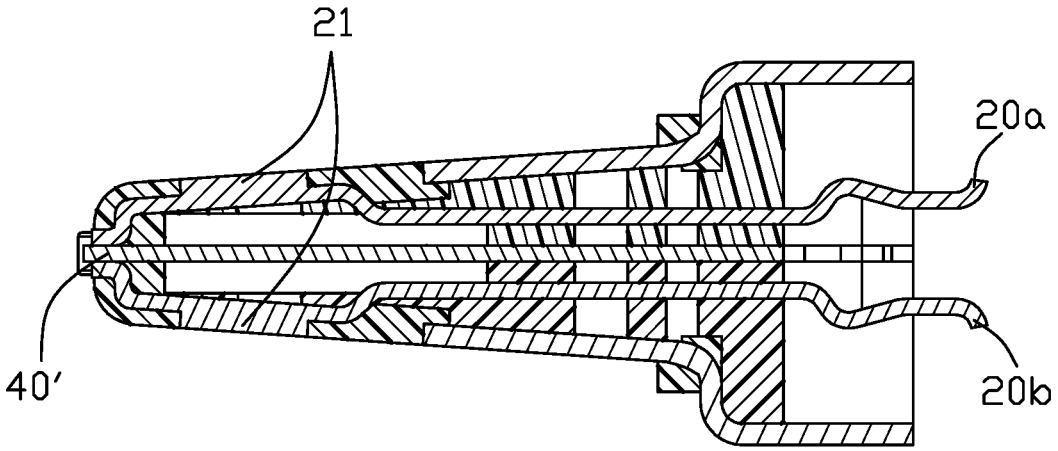
FIG. 6 is another cross-sectional view of the electrical connector of FIG. 1.

Notably, a grounding path from the contacting section 21 of the grounding contact of the upper/lower contact 20*a*/20*b*, the upward/downward spring beam 413/414, the plate section 41, the ear 40 of the shielding plate 40, the leg 53 of the upper/lower shell 50*a*/50*b*, is established. FIG. 6 shows another embodiment wherein the contacting sections 21 of the grounding contacts of the upper contact 20*a* and the lower contact 20*b* abut against the shielding plate 40', and optimally soldered thereto for securing consideration.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an upper contact module including a plurality of upper contacts integrally formed with an upper insulator, each of said upper contacts including a contacting section;

a lower contact module including a plurality of lower contacts integrally formed with a lower insulator, each of said lower contacts including a contacting section;

the upper contacts and the lower contacts being symmetric with each other in a vertical direction; and a metallic shielding plate sandwiched between the upper contact module and the lower contact module in said vertical direction to form a sub-assembly, said shielding plate including at least an upward spring beam and a downward spring beam intimately side by side arranged and paired with each other in a transverse direction perpendicular to said vertical direction and commonly extending in a front-to-back direction perpendicular to both said vertical direction and said transverse direction to respectively contact the contacting section of one grounding contact of the upper contacts and the contacting section of one grounding contact of the lower contacts in the vertical direction; wherein said one grounding contact of the upper contacts is aligned with said one grounding contact of the lower contacts in the vertical direction.

2. The electrical connector as claimed in claim 1, further including an insulative housing applied upon the sub-assembly for securing the sub-assembly together, wherein said housing includes a base and a mating tongue extending forwardly from the base, said mating tongue defining opposite mating surfaces to be coplanar with corresponding contacting sections of the upper contacts and those of the lower contacts.

3. The electrical connector as claimed in claim 2, further including a metallic upper shell and a metallic lower shell integrally formed with the housing.

4. The electrical connector as claimed in claim 3, wherein said shielding plate includes a pair of ears at two opposite ends in the transverse direction, and each of the upper shell and the lower shell further include a pair of legs at two opposite ends in the transverse direction, and the ears are sandwiched between the corresponding legs of the upper shell and those of the lower shell.

5. The electrical connector as claimed in claim 1, wherein said upward spring beam and said downward spring beam are commonly formed in a hole of the shielding plate.

6. The electrical connector as claimed in claim 5, wherein said upward spring beam and said downward spring beam extend from a common edge in the hole and along a same direction along said front-to-back direction.

7. The electrical connector as claimed in claim 6, wherein along the transverse direction, the contacting section defines a width dimensioned approximately a sum of widths of the upward spring beam and the downward spring beam.

8. An electrical connector comprising:

an insulative housing forming a base and a mating tongue forwardly extending from the base along a front-to-back direction, said mating tongue defining opposite upper and lower mating surfaces in a vertical direction perpendicular to said front-to-back direction;

a plurality of upper contacts disposed in the housing with contacting sections exposed upon the upper mating surface, said upper contacts including grounding contacts;

a plurality of lower contacts disposed in the housing with contacting sections exposed upon the lower mating surface, said lower contacts including grounding contacts; and a metallic shielding plate disposed in the housing and located between the upper contacts and the lower contacts in the vertical direction; wherein said shielding plate forms at least paired upward spring beam and downward spring beam to respectively contact the contacting section of one grounding contact of the upper contacts and the contacting section of one grounding contact of the lower contacts in the vertical direction; wherein said one grounding contact of the upper contacts is aligned with said one grounding contact of the lower contacts in the vertical direction.

9. The electrical connector as claimed in claim 8, wherein said upper contacts are integrally formed within an upper insulator, and said lower contacts are integrally formed within a lower insulator, and said shielding plate is sandwiched between the upper insulator and the lower insulator.

10. The electrical connector as claimed in claim 9, further including a metallic upper shell and a metallic lower shell integrally formed with the housing.

11. The electrical connector as claimed in claim 10, wherein said shielding plate includes a pair of ears at two opposite ends in the transverse direction, and each of the upper shell and the lower shell further include a pair of legs at two opposite ends in the transverse direction, and the ears are sandwiched between the corresponding legs of the upper shell and those of the lower shell.

12. The electrical connector as claimed in claim 8, wherein said paired upward spring beam and downward spring beam are side by side arranged with each other in a transverse direction perpendicular to both said front-to-back direction and said vertical direction.

13. The electrical connector as claimed in claim 12, wherein said paired upward spring beam and downward spring beam are commonly formed within one common hole in the shielding plate.

14. The electrical connector as claimed in claim 13, wherein the upward spring beam and the downward spring beam extend from a same edge in the common hole along a same direction in said front-to-back direction.

15. The electrical connector as claimed in claim 12, wherein along a transverse direction, the contacting section defines a width dimensioned approximately a sum of widths of the upward spring beam and the downward spring beam.

16. An electrical connector comprising:

an insulative housing forming a base and a mating tongue forwardly extending from the base along a front-to-back direction, said mating tongue defining opposite upper and lower mating surfaces in a vertical direction perpendicular to said front-to-back direction;

a plurality of upper contacts disposed in the housing with contacting sections exposed upon the upper mating surface, said upper contacts including grounding contacts;

a plurality of lower contacts disposed in the housing with contacting sections exposed upon the lower mating surface, said lower contacts including grounding contacts; and a metallic shielding plate disposed in the housing and located between the upper contacts and the lower contacts in the vertical direction; wherein said shielding plate forms at least a paired upward spring beam and downward spring beam to respectively contact the contacting section of one grounding contact of the upper contacts and the contacting section of one grounding contact of the lower contacts in the vertical direction; wherein along a transverse direction, the contacting section defines a width dimensioned approximately a sum of widths of the upward spring beam and the downward spring beam.

17. The electrical connector as claimed in claim 16, wherein said paired upward spring beam and downward spring beam are side by side arranged with each other in a transverse direction perpendicular to both said front-to-back direction and said vertical direction.

18. The electrical connector as claimed in claim 17, wherein said paired upward spring beam and downward spring beam are commonly formed within one common hole in the shielding plate.

19. The electrical connector as claimed in claim 18, wherein the upward spring beam and the downward spring beam extend from a same edge in the common hole along a same direction in said front-to-back direction.

* * * * *